US010937281B1

(12) United States Patent
Mueller

(10) Patent No.: US 10,937,281 B1
(45) Date of Patent: Mar. 2, 2021

(54) SECURITY FLAPS FOR USE WITH CASH TRAYS AND CASH TRAYS INCLUDING SUCH SECURITY FLAPS

(71) Applicant: WALGREEN CO., Deerfield, IL (US)

(72) Inventor: Timothy Patrick Mueller, Grayslake, IL (US)

(73) Assignee: WALGREEN CO., Deerfield, IL (US)

( * ) Notice: Subject to any disclaimer, the term of this patent is extended or adjusted under 35 U.S.C. 154(b) by 0 days.

(21) Appl. No.: 16/547,115

(22) Filed: Aug. 21, 2019

Related U.S. Application Data

(63) Continuation of application No. 15/980,424, filed on May 15, 2018, now Pat. No. 10,403,099.

(51) Int. Cl.
*G07G 1/00* (2006.01)

(52) U.S. Cl.
CPC ..... *G07G 1/0027* (2013.01)

(58) Field of Classification Search
CPC ..... G07D 11/125; G07D 11/12; G07D 11/16; G07D 11/10
USPC ..... 235/7 R, 10, 22, 379
See application file for complete search history.

(56) References Cited

U.S. PATENT DOCUMENTS

| | | | | |
|---|---|---|---|---|
| 5,380,990 | A | 1/1995 | Baitz et al. | |
| 5,451,753 | A | 9/1995 | Leatherwood et al. | |
| 5,615,624 | A | 4/1997 | Terry et al. | |
| 6,003,690 | A | 12/1999 | Allen et al. | |
| 6,719,196 | B2 | 4/2004 | Fukuyama | |
| 9,159,204 | B2 | 10/2015 | Yonemaru | |
| 9,911,289 | B2 * | 3/2018 | Ting | G07G 1/0027 |
| 1,040,309 | A1 | 9/2019 | Mueller | |

OTHER PUBLICATIONS

Office Action for U.S. Appl. No. 15/980,424, dated Jan. 10, 2019.

* cited by examiner

*Primary Examiner* — Jamara A Franklin
(74) *Attorney, Agent, or Firm* — Marshall, Gerstein & Borun LLP; Randall G. Rueth

(57) ABSTRACT

Security flaps for use with cash trays and cash trays including such security flaps are disclosed. An apparatus includes a cash tray having a base and a plurality of walls that extend from the base and define a plurality of paper-currency compartments. A plurality of distal edges of the walls define openings of the paper-currency compartments. A spring-biased security flap is coupled to the cash tray and adapted to engage or be immediately adjacent the distal edges of the walls of at least one of the paper-currency compartments to cover the corresponding opening.

21 Claims, 14 Drawing Sheets

SECURITY FLAPS FOR USE WITH CASH TRAYS AND CASH TRAYS INCLUDING SUCH SECURITY FLAPS

RELATED APPLICATION

This patent is a continuation of U.S. patent application Ser. No. 15/980,424, filed May 15, 2018, which is hereby incorporated herein by reference in its entirety.

FIELD OF THE DISCLOSURE

The present patent relates generally to security flaps for use with cash trays and, in particular, relates to security flaps for use with cash trays and cash trays including such security flaps.

BACKGROUND

Cash registers include drawers that are movable between an open position in which contents of the drawer can be easily accessed and a closed position in which contents of the drawer cannot be easily accessed. In some examples, the drawer receives a tray having slots that are structured to house currency including paper currency and/or coins.

DETAILED DESCRIPTION

Figure 1:
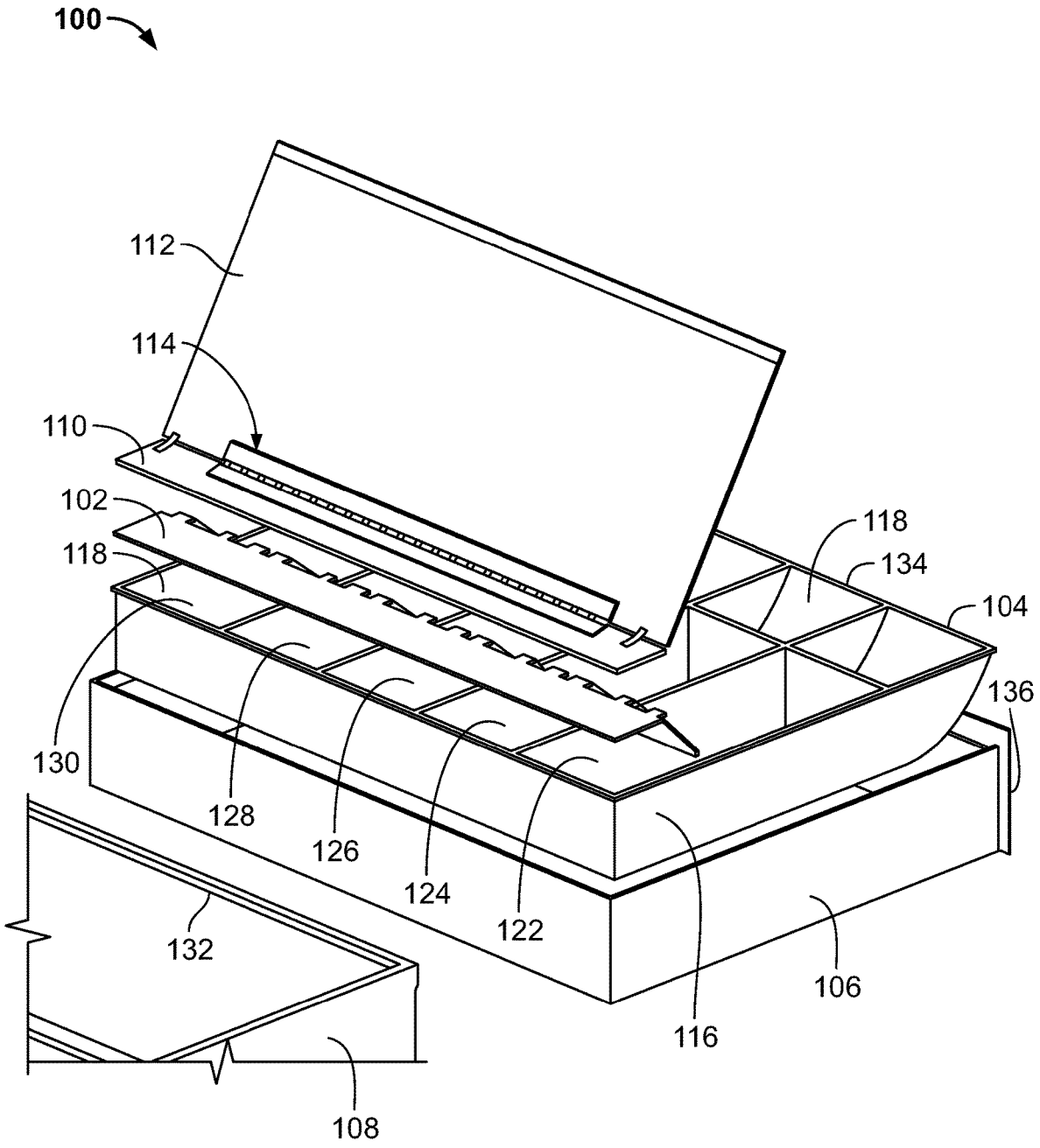
FIG. 1 illustrates an isometric exploded view of an example cash tray assembly including an example cash tray and an example cash register housing that is structured to receive the cash tray and a cash register drawer.

Although the following text discloses a detailed description of example methods, apparatus and/or articles of manufacture, it should be understood that the legal scope of the property right is defined by the words of the claims set forth at the end of this patent. Accordingly, the following detailed description is to be construed as examples only and does not describe every possible example, as describing every possible example would be impractical, if not impossible. Numerous alternative examples could be implemented, using either current technology or technology developed after the filing date of this patent. It is envisioned that such alternative examples would still fall within the scope of the claims.

The examples disclosed herein relate to example cash tray assemblies having example security flaps that prevent visual access to contents of one or more compartments of an associated cash tray unless a cashier chooses to access the one or more compartments and/or unless an event occurs. The event may include a cash transaction taking place and/or the cash tray extending a threshold distance out of a cash register housing. Thus, based on the teachings of this disclosure, if a non-cash transaction occurs, the cash tray and the register drawer may move from the register housing toward a first position where the security flap continues to cover paper-currency compartments of the cash tray and visually prevents access to the paper-currency trays. Also, based on the teachings of this disclosure, if a cash transaction occurs, the cash tray and the register drawer may move further from the register housing toward a second position where the security flap does not cover the paper-currency compartments of the cash tray and visually enables access to the paper-currency compartments. Put another way, the examples disclosed herein enable cash trays and register drawers to extend from the register housing while still preventing individuals from determining contents of the cash tray. Such an approach may deter an individual from being enticed into performing a criminal act that may otherwise occur if the individual viewed the contents of the cash tray.

In some examples, a spring biases the security flap toward an open position and a hinge couples the security flap to the cash tray. To prevent the biased- security flap from inadvertently moving toward an open position, in some examples, the hinge is positioned to cause the security flap to engage the register housing and to remain in the closed position covering the compartments of the cash tray when the cash tray and the register drawer extend a first distance from the register housing. To enable the security flap to move toward the open position, in some examples, the hinge is positioned to enable the security flap to rotate about the hinge toward an open position when the cash tray and the register drawer extend a second distance from the register housing. In this example, when the cash tray is in the second position, the interaction between the security flap and the register housing is reduced and/or the hinge is spaced from an end of the register housing to enable the security flap to move toward the open position.

In some examples, the security flap includes an example first panel that is coupled to the cash tray and an example second panel that is coupled to the first panel via a hinge. The hinge may be a piano hinge, a living hinge or any other type of hinge. When the hinge is implemented as a piano hinge, the first and second panels of the security flap may be formed of separate pieces. In some such examples, the first panel is integral with the cash tray or the first panel is a separate component structured to be coupled to the cash tray and/or the second panel. If the first panel is a separate component, the first panel may be coupled to a rear panel of the cash tray and/or one or more upward facing surfaces (e.g., flanges) of the cash tray using fasteners or any other method (e.g., an interference fit between the first panel and the cash tray). When the hinge is implemented as a living hinge, the first and second panels may be formed of a single component. In some such examples, the first and second panels are integrally formed with the cash tray such that the cash tray and the security flap are formed of a single piece. In other examples, the first and second panels are formed separately from the cash tray such that the security flap is structured to be coupled to the cash tray.

Regardless of how the security flap is formed and/or coupled to the cash tray, in some examples, one or more actuators are included to bias the second panel of the security flap toward the open position. When the actuators are implemented as springs, the springs may be associated with the hinge and/or may be coupled to the security flap using fasteners. The springs may be implemented as torsion springs, spring hinges or any other type of spring. The fasteners may be implemented by eyelets that receive or house portions of the springs, tape, rivets, bolts, screws or any other type of fastener.

To further encourage the second panel of the security flap toward the open position and/or to change (e.g., increase) an amount of force output by the springs, in some examples, the security flaps include stiffeners that extend from the springs and are coupled to the second panel. The stiffeners may increase leverage provided to the springs to enable the springs to more easily move the second panel toward the open position. Such an approach may enable springs of different sizes (e.g., smaller sizes) to be used. The stiffeners may be coupled to the second panel of the security flap using fasteners.

FIG. 1 illustrates an example security flap 100, an example spring hinge 102, an example cash tray 104, an example register drawer 106 and an example register housing 108 that is structured to receive the cash tray 104 and the register drawer 106. In the illustrated example, the security flap 100 includes an example first panel 110 and an example second panel 112 coupled to the first panel 110 via an example hinge 114. The hinge 114 enables the second panel 112 to move between a first and/or closed position and a second and/or open position. In the closed position, the second panel 112 is structured to engage and/or be positioned immediately adjacent sides 116, 118, 120 of the cash tray 104 to cover and/or prevent visual access to paper currency compartments 122, 124, 126, 128, 130 of the cash tray 104. In the open position, the second panel 112 is structured to be spaced from the sides 116, 118, 120 of the cash tray 104 to uncover and/or enable visual access to the paper currency compartments 122, 124, 126, 128, 130. In this example, the second panel 112 engages the sides 116, 118, 120 such that the second panel 112 does not extend into a dimensional envelope of the cash tray 104 when the security flap 100 is in the closed position. However, in other examples, the second panel 112 extends into the dimensional envelope of the cash tray 104 when the security flap 100 is in the closed position.

To control the actuation of the second panel 112 between the closed position and the open position, the first panel 110 is sized and/or the hinge 114 is positioned to enable the second panel 112 to interact with an interior surface 132 of the register housing 108. The interaction between the second panel 112 and the interior surface 132 prevents the second panel 112 from moving toward the open position when the cash tray 104 and the register drawer 106 are fully positioned within the register housing 108 and when ends 134, 136 of the cash tray 104 and the register drawer 106 are a threshold distance from the register housing 108. In some examples, the threshold distance is associated with a non-cash transaction taking place where the ends 134, 136 of the cash tray 104 and the register drawer 106 are spaced from the register housing 108. To enable the second panel 112 to move from the closed position to the open position, the first panel 110 is sized and/or the hinge 114 is positioned to enable the second panel 112 to not substantially interact with the interior surface 133 of the register housing 108 when the ends 134, 136 of the cash tray 104 and the register drawer 106 are spaced a second threshold distance from the register housing 108. In some examples, the second threshold distance is associated with a cash transaction taking place.

Figure 2:
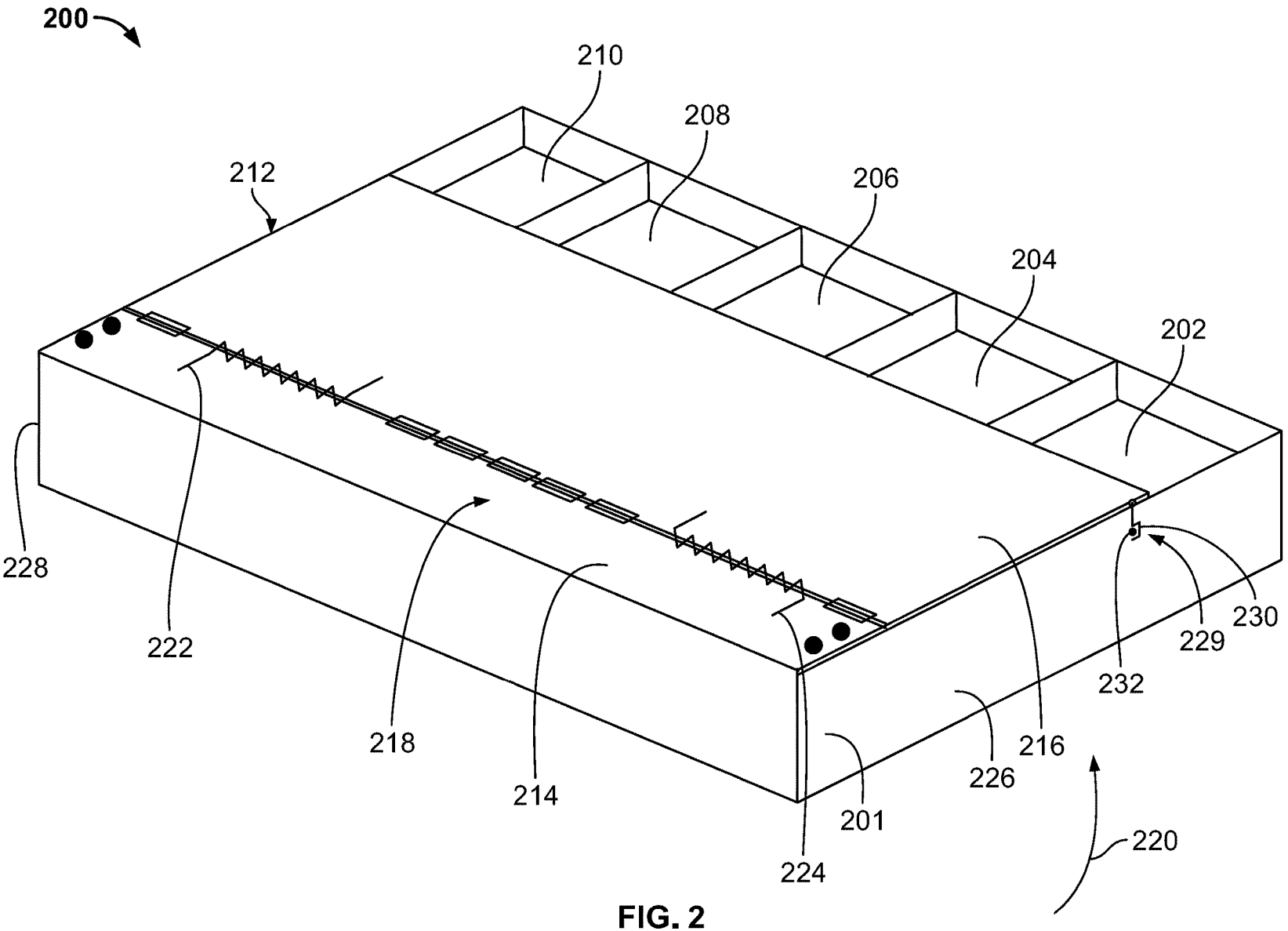
FIG. 2 illustrates an isometric view of another example cash tray assembly that can be used to implement the cash tray assembly of FIG. 1, where an example security flap includes an example panel to couple the security flap to the cash tray.

FIG. 2 illustrates an example cash tray assembly 200 including an example cash tray 201 having coin compartments 202, 204, 206, 208 and 210 and an example security flap 212 including a first panel 214 and a second panel 216. In the illustrated example, the second panel 216 is coupled to the first panel 214 via hinges 218 and is biased in a direction generally indicated by arrow 220 via springs 222, 224. In some examples, the springs 222, 224 are coupled between the first and second panels 214, 216 via the hinges 218 and/or are otherwise coupled between the first and second panels 214, 216 using one or more fasteners (e.g., tape).

To enable the second panel 216 to engage or be positioned immediately adjacent sides 226, 228 of the cash tray 201 when the cash tray 201 is completely removed from the register housing 108, in this example, the cash tray assembly 200 includes a lock 229 including a latch 230 of the second panel 216 that interacts with and/or receives a protrusion 232 of the cash tray 201. In other examples, the second panel 216 may be secured to the sides 226, 228 of the cash tray 201 in any other suitable way. For example, a hook and loop fastener may be used to secure the second panel 216 to the sides 226, 228 of the cash tray 201. In some such examples, when the cash tray 201 is completely removed from the register housing 108, the hook and loop fastener may extend between the second panel 216 and the sides 226 and/or 228 of the cash tray 201 to secure the second panel 216 in place. When the cash tray 201 is received within the register housing 108, the hook and loop fastener may not extend between the second panel 216 and the sides 226, 228 to enable the second panel 216 to freely move between the closed position shown in FIGS. 2 and 3 and the open position shown in FIG. 4. When the hook and loop fastener is not being used to secure the second panel 216 to the cash tray 201, the hook and loop fastener may be secured to itself.

Figure 3:
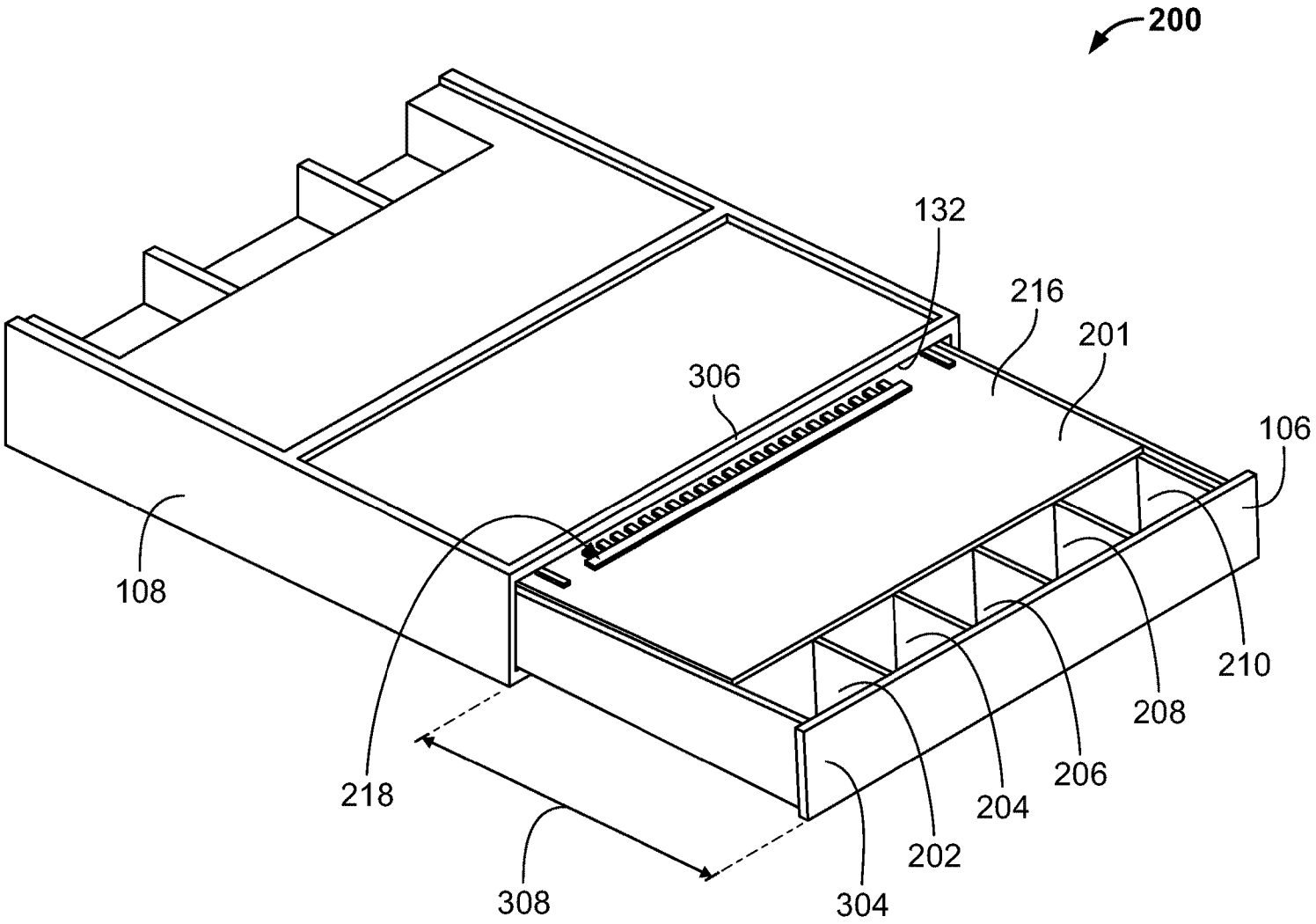
FIG. 3 illustrates an isometric view of the example cash tray assembly of FIG. 2 with the cash tray and the register drawer extending from the cash register housing and the security flap in a closed position.

FIG. 3 illustrates the example cash tray 201 disposed within the register drawer 106 and being received within the register housing 108. The example illustrates the second panel 216 interacting with and/or engaging the interior surface 132 of the register housing 108 causing the second panel 216 to be in the closed position. As shown, the interaction between the second panel 216 and the interior surface 132 of the register housing 108 prevents the paper currency compartments 402, 404, 406, 408, 410 from being visually accessed when an end 304 of the cash tray 201 is spaced a first distance 308 from an end 306 of the register housing 108 and/or when a non-cash transaction is taking place.

Figure 4:
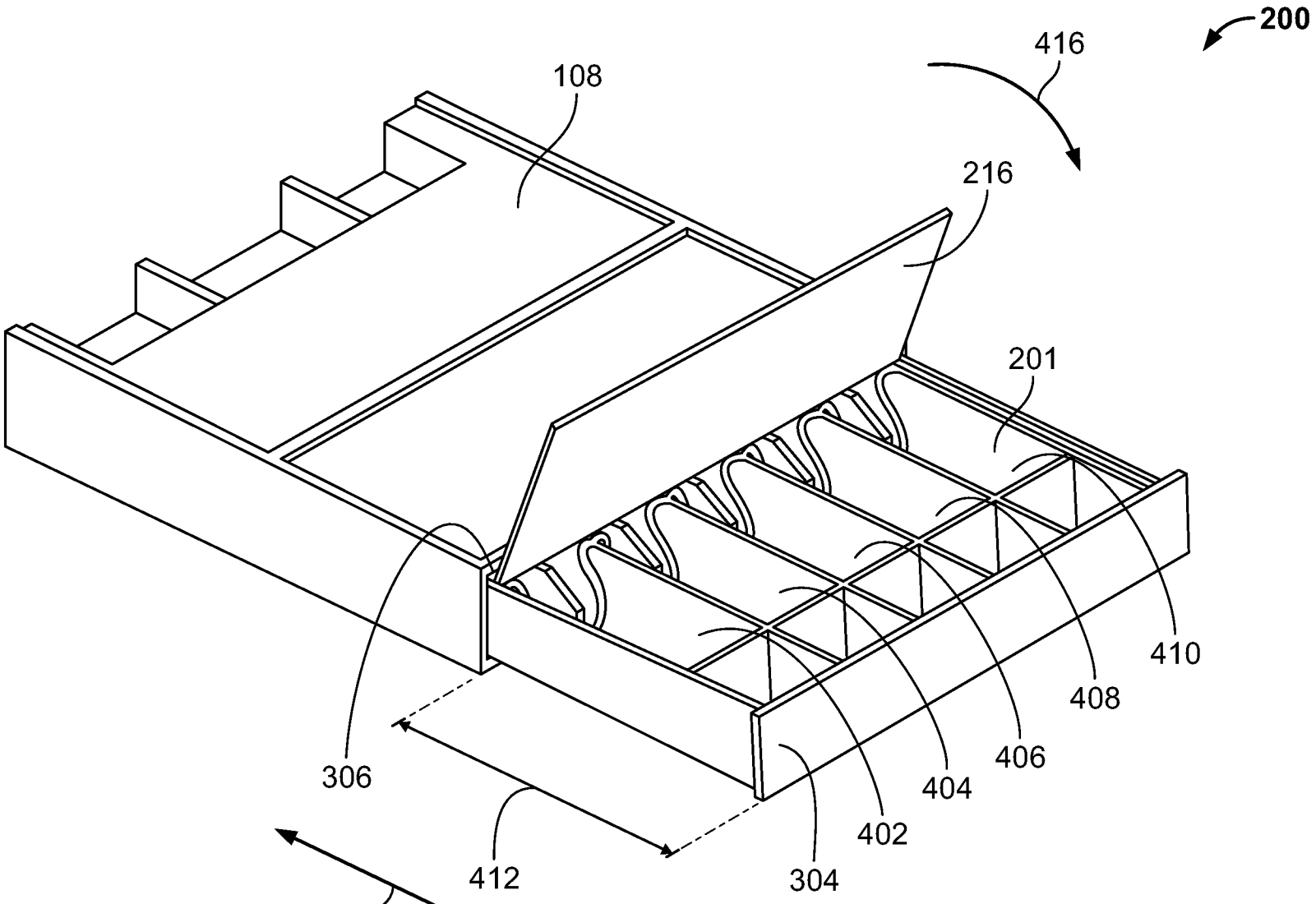
FIG. 4 illustrates an isometric view of the example cash tray assembly of FIG. 2 with the cash tray and the register drawer extending further from the cash register housing and the security flap in an open position.

FIG. 4 illustrates the end 304 of the cash tray 201 being spaced a second distance 412 from the end 306 of the register housing 108 to enable the second panel 216 to rotate about the hinges 218 and move from the closed position of FIGS. 2 and 3 to the open position of FIG. 4. As shown in FIG. 4, when the second panel 216 is in the open position, the paper currency compartments 402, 404, 406, 408, 410 are accessible (e.g., visually accessible). In some examples, to move the second panel 216 from the open position shown in FIG. 4 to the closed position shown in FIG. 3, an operator of the cash register may move the cash tray 201 and the register drawer 106 in a direction generally indicated by arrow 414 a threshold distance and/or a distance that positions the hinges 218 within the dimensional envelope of the register housing 108. Put another way, the second panel 216 may move to the closed position when the second panel 216 interacts with the interior surface 132, urging the second panel 216 in a direction generally indicated by arrow 416 against the biasing force of the springs 222, 224 to prevent visual access to the paper currency compartments 402, 404, 406, 408, 410, for example.

Figure 5:
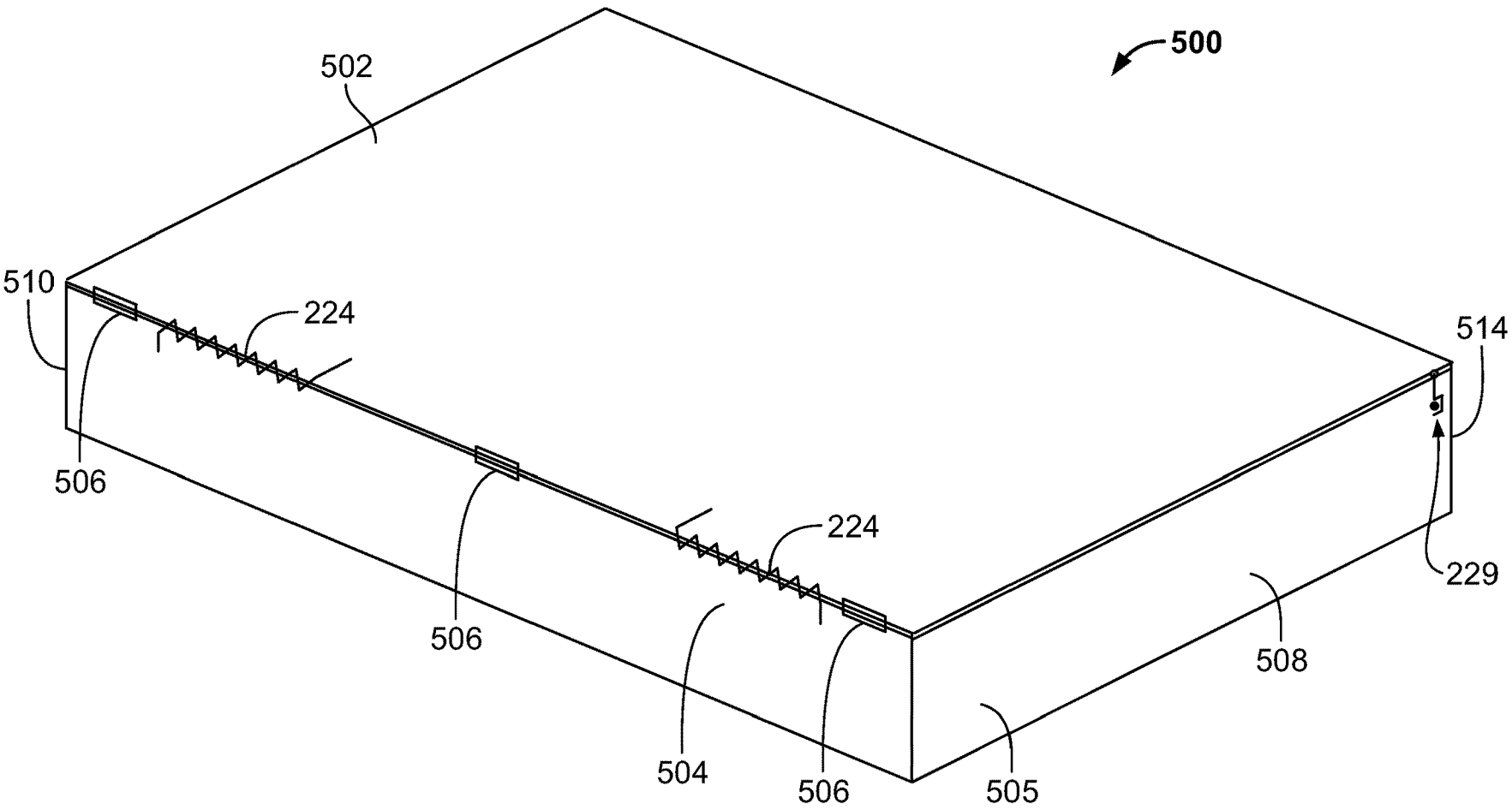
FIG. 5 illustrates another example cash tray assembly that can be used to implement the cash tray assembly of FIG. 1, where an example security flap is hingably coupled to an example rear panel of the cash tray.

FIG. 5 illustrates an example cash tray assembly 500 that is similar to the cash tray assembly 200 of FIG. 2. However, in contrast to the cash tray assembly 200 of FIG. 2, the cash tray assembly 500 of FIG. 5 includes an example security flap 502 that is directly coupled to a rear panel 504 of a cash tray 505 via hinges 506. Also, in contrast to the cash tray assembly 200 of FIG. 2, the security flap 502 is sized and/or structured to cover the coin compartments 202, 204, 206, 208 and 210 and the paper currency compartments 402, 404, 406, 408, 410 when the security flap 502 is in the closed position. In this example, the security flap 502 extends between sides 508, 510 of the cash tray 500 and between the rear panel 504 and a front panel 514 engaging surfaces thereof when the security flap 502 is in the closed position.

Figure 6:
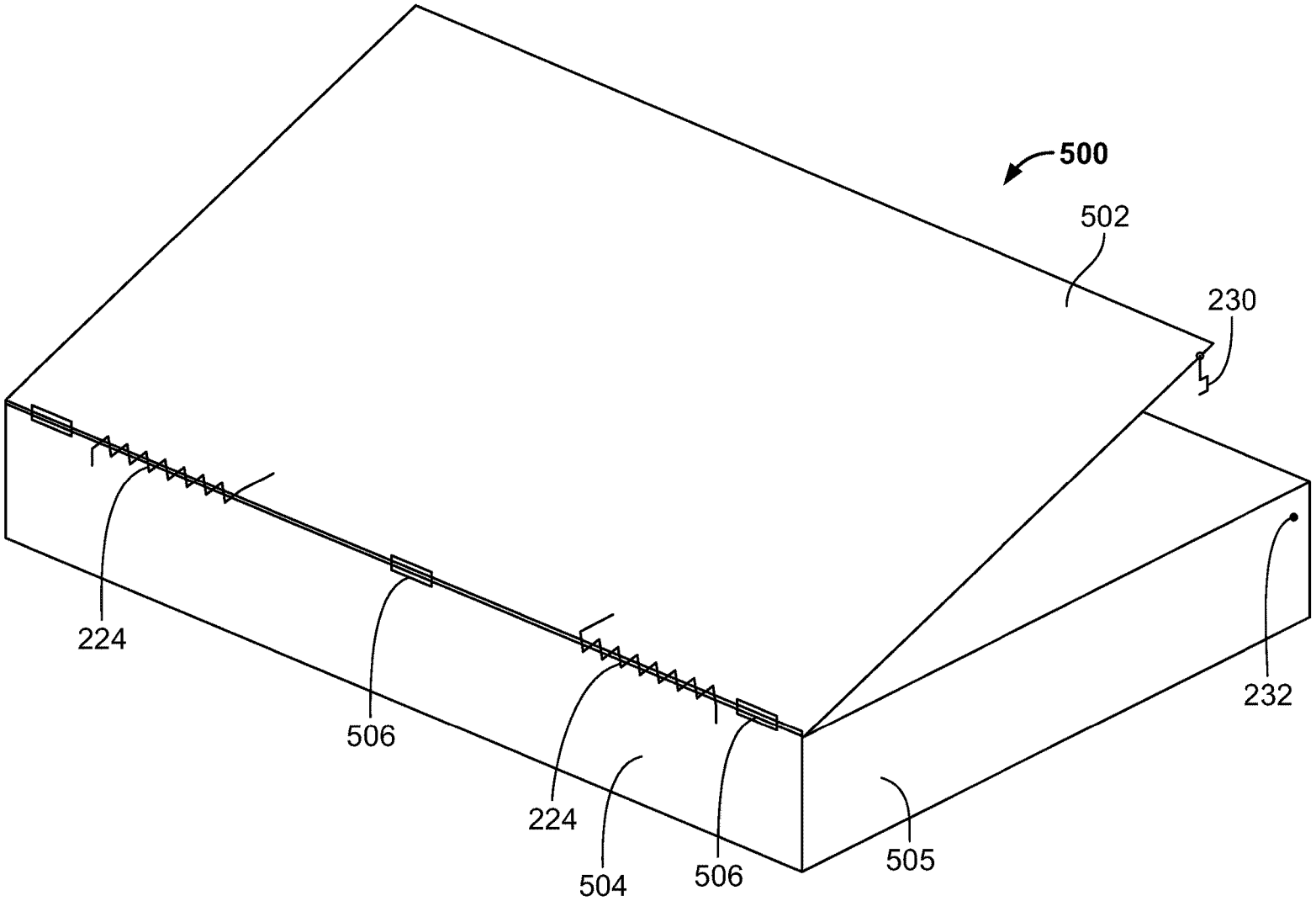
FIG. 6 illustrates the example cash tray assembly of FIG. 5 with the security flap in an open position.

FIG. 6 illustrates the security flap 502 of the cash tray assembly 500 of FIG. 5 in an open position enabling access (e.g., visual access, physical access) to the coin compartments 202, 204, 206, 208 and 210 and/or the paper currency compartments 402, 404, 406, 408, 410.

Figure 7:
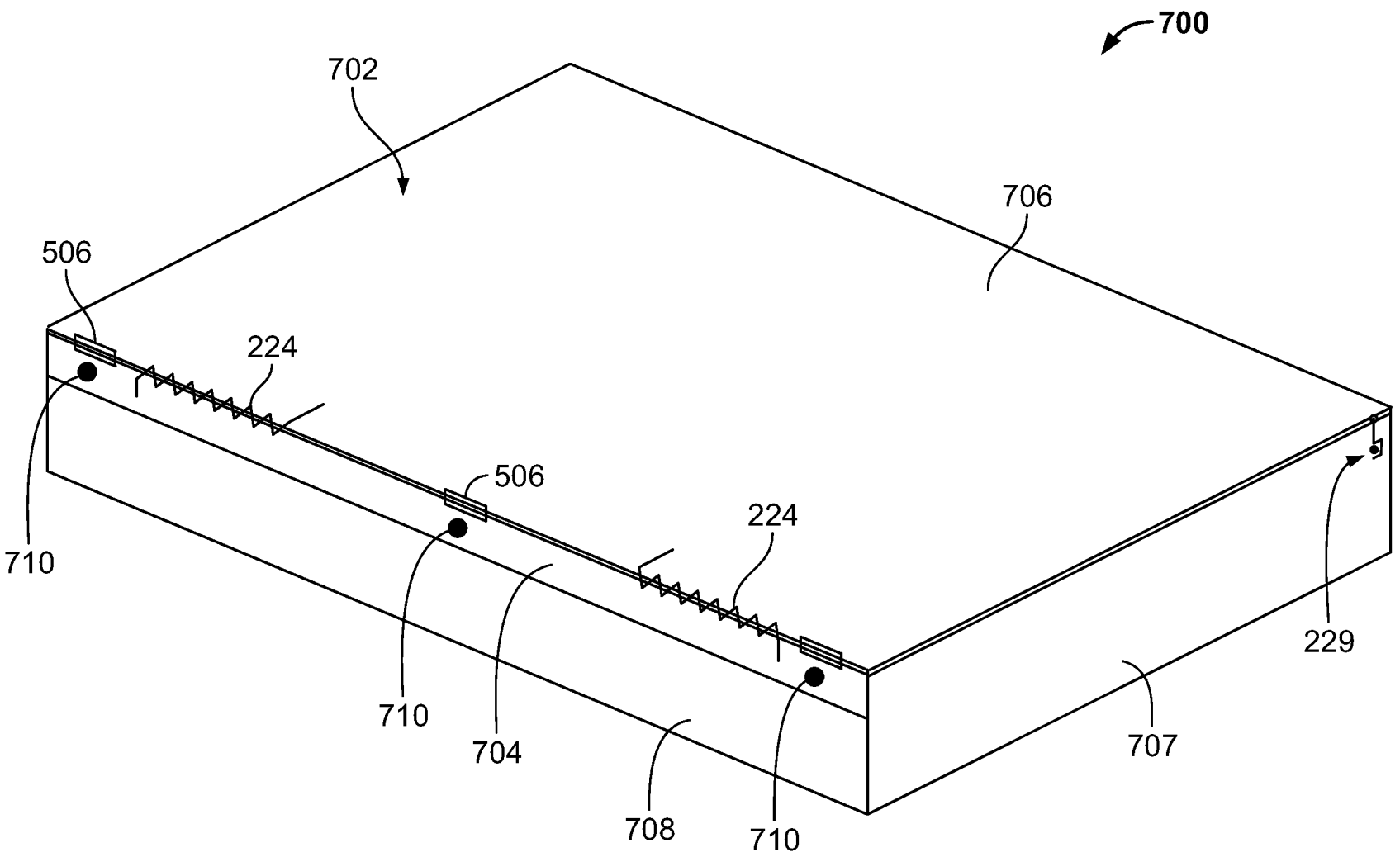
FIG. 7 illustrates another example cash tray assembly including an example security flap that can be used to implement the cash tray assembly of FIG. 1, where the security flap includes an example bracket to couple the security flap to a rear panel of the cash tray.

FIG. 7 illustrates an example cash tray assembly 700 that is similar to the cash tray assembly 500 of FIG. 5. However, in contrast to the cash tray assembly 500 of FIG. 5, the cash tray assembly 700 of FIG. 7 includes an example security flap 702 including a first panel 704 and a second panel 706, where the second panel 706 covers the coin compartments 202, 204, 206, 208 and 210 and the paper currency compartments 404, 406, 408 and 410 in the closed position and the first panel 704 is coupled to an example rear panel 708 of a cash tray 707 via fasteners 710. The fasteners 710 may be bolts, rivets, adhesive, a hook and loop fastener or any other type of fastener. To couple the first and second panels 704, 706 together and to enable the second panel 706 to be biased toward the open position, in the illustrated example, the hinges 506 are disposed between the panels 704, 706 and the springs 224 are positioned and/or structured to urge the second panel 706 toward the open position when an event occurs. In some examples, the event is associated with the cash tray 707 extending from the register housing 108 a threshold distance, a cash transaction taking place and/or accessing contents of the cash tray 707.

Figure 8:
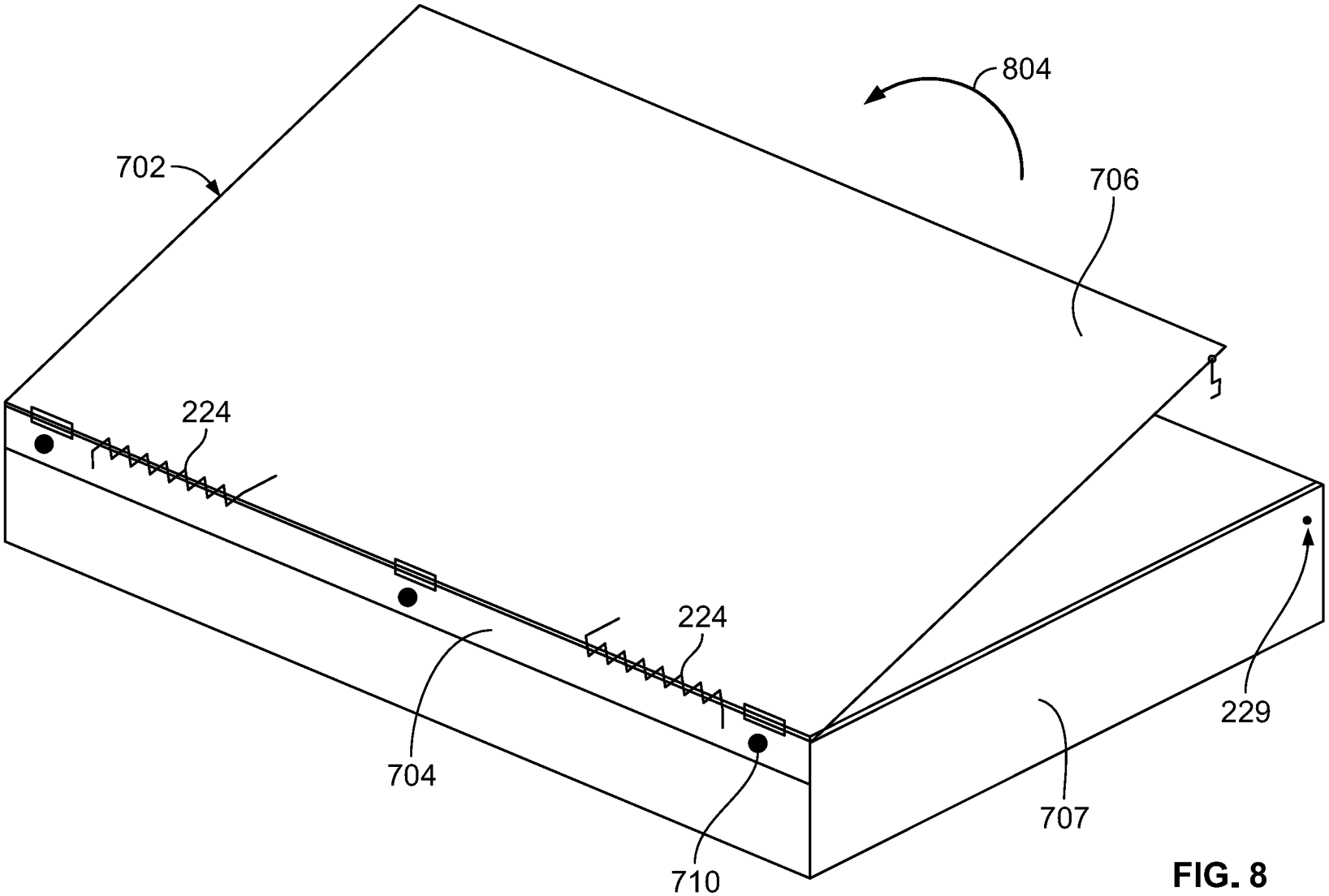
FIG. 8 illustrates the example cash tray assembly of FIG. 7 with the security flap in an open position.

FIG. 8 illustrates the example second panel 706 moving in a direction generally indicated by arrow 804 to enable access to contents of the cash tray 707. Put another way, FIG. 8 illustrates the second panel 706 in or moving toward the open position.

Figure 9:
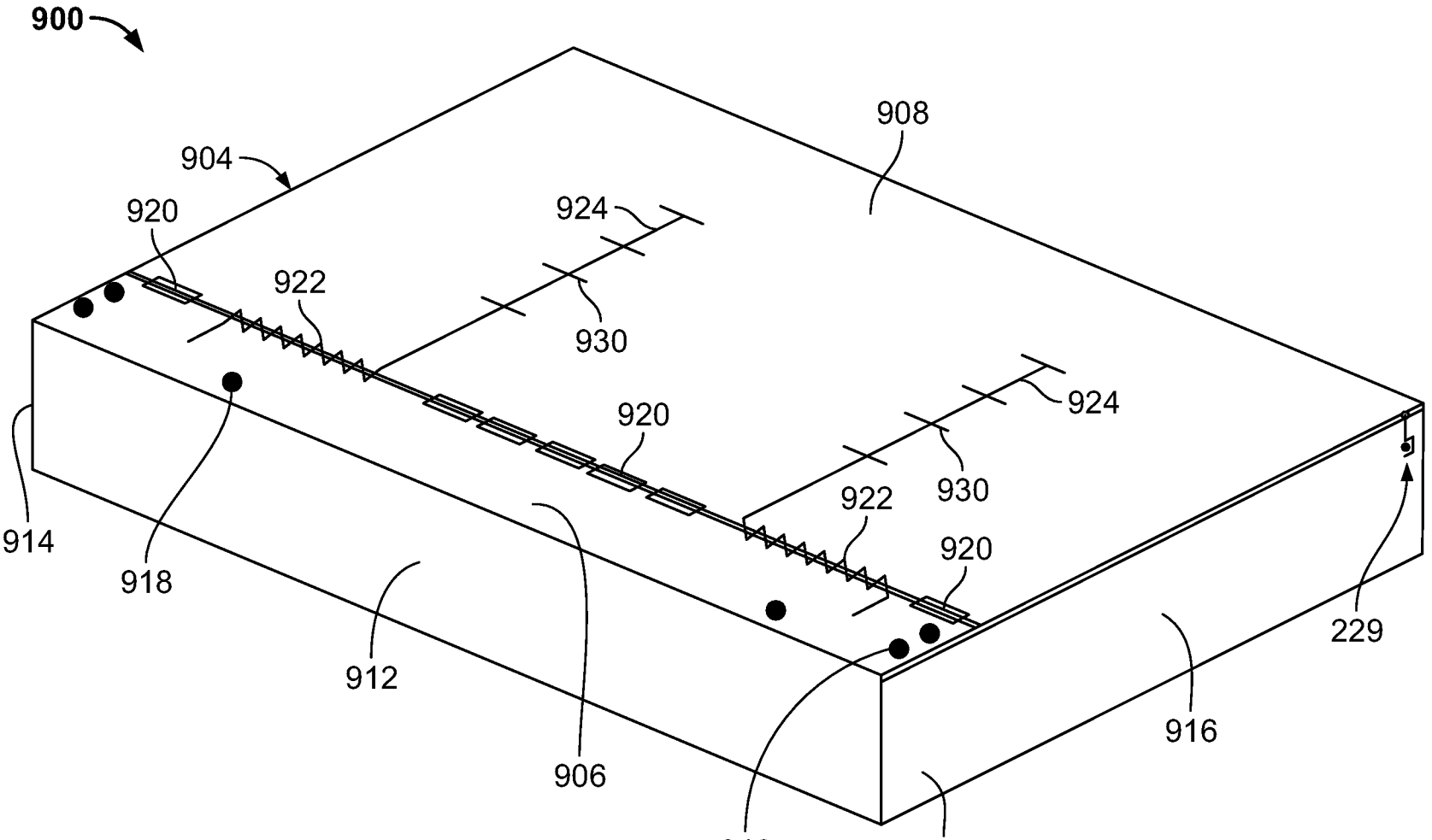
FIG. 9 illustrates another example cash tray assembly that can be used to implement the cash tray assembly of FIG. 1, where an example security flap includes an example panel to couple the security flap to side panels of the cash tray.

FIG. 9 illustrates an example cash tray assembly 900 that is similar to the cash tray assembly 700 of FIG. 7. However, in contrast to the cash tray assembly 700 of FIG. 7, the cash tray assembly 900 of FIG. 9 includes an example security flap 904 including a first panel 906 and a second panel 908, where the first panel 906 is coupled to sides 910, 912, 914 of a cash tray 916 via fasteners 918 and the first and second panels 906, 908 are coupled together using hinges 920. To increase an amount of leverage provided to example springs 922 that encourage the second panel 908 to move toward the open position, in this example, extensions and/or stiffeners 924 extend from the springs 922 adjacent an interface between the first and second panels 906, 908. In some examples, the extensions 924 are integral to the springs 922 and are coupled to the second panel 908 using fasteners 930. In other examples, the cash tray assembly 900 may not include the extensions 924.

Figure 10:
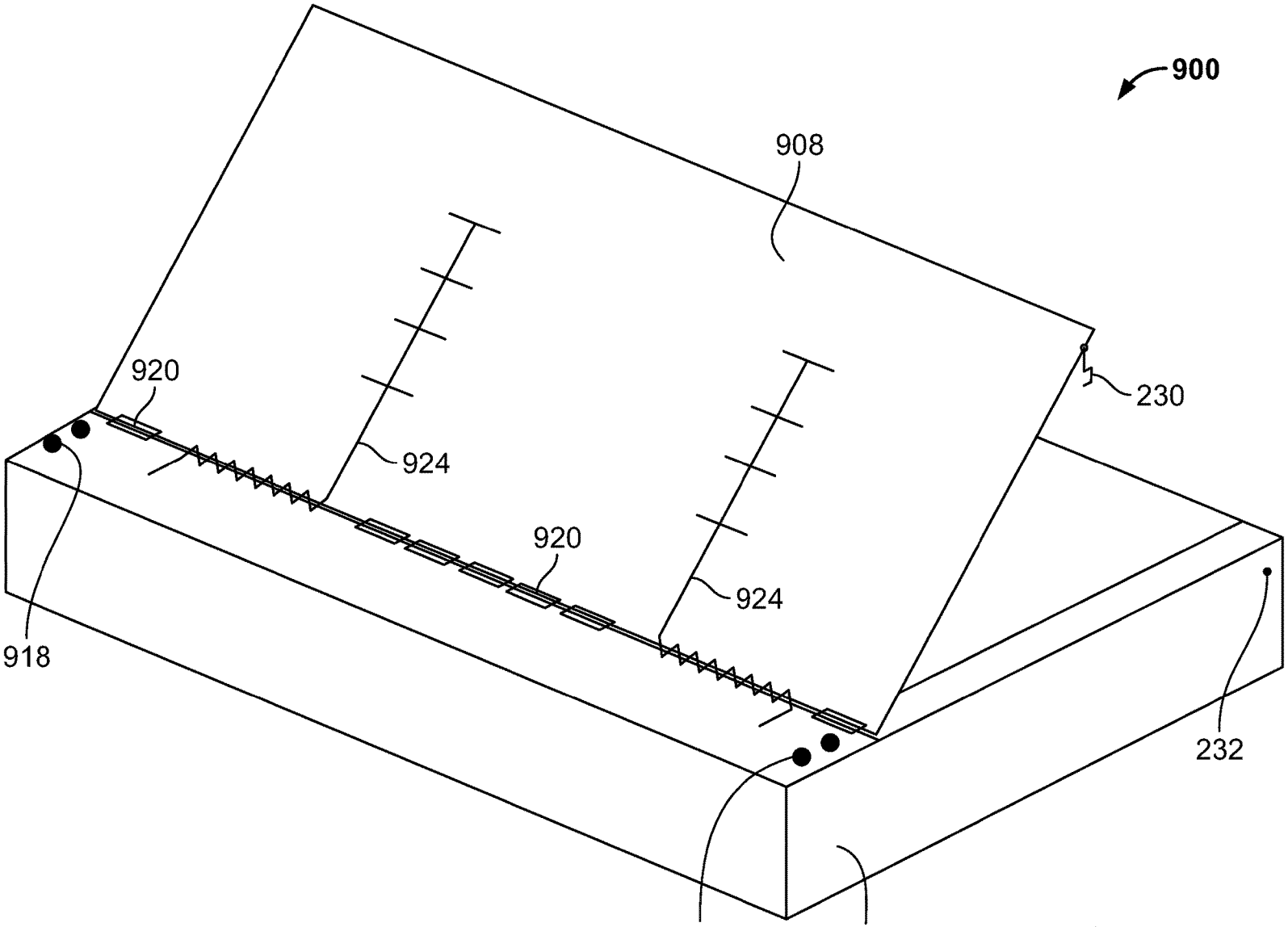
FIG. 10 illustrates the example cash tray assembly of FIG. 9 in an open position.

FIG. 10 illustrates the second panel 908 of the example cash tray assembly 900 of FIG. 9 in an open position.

Figure 11:
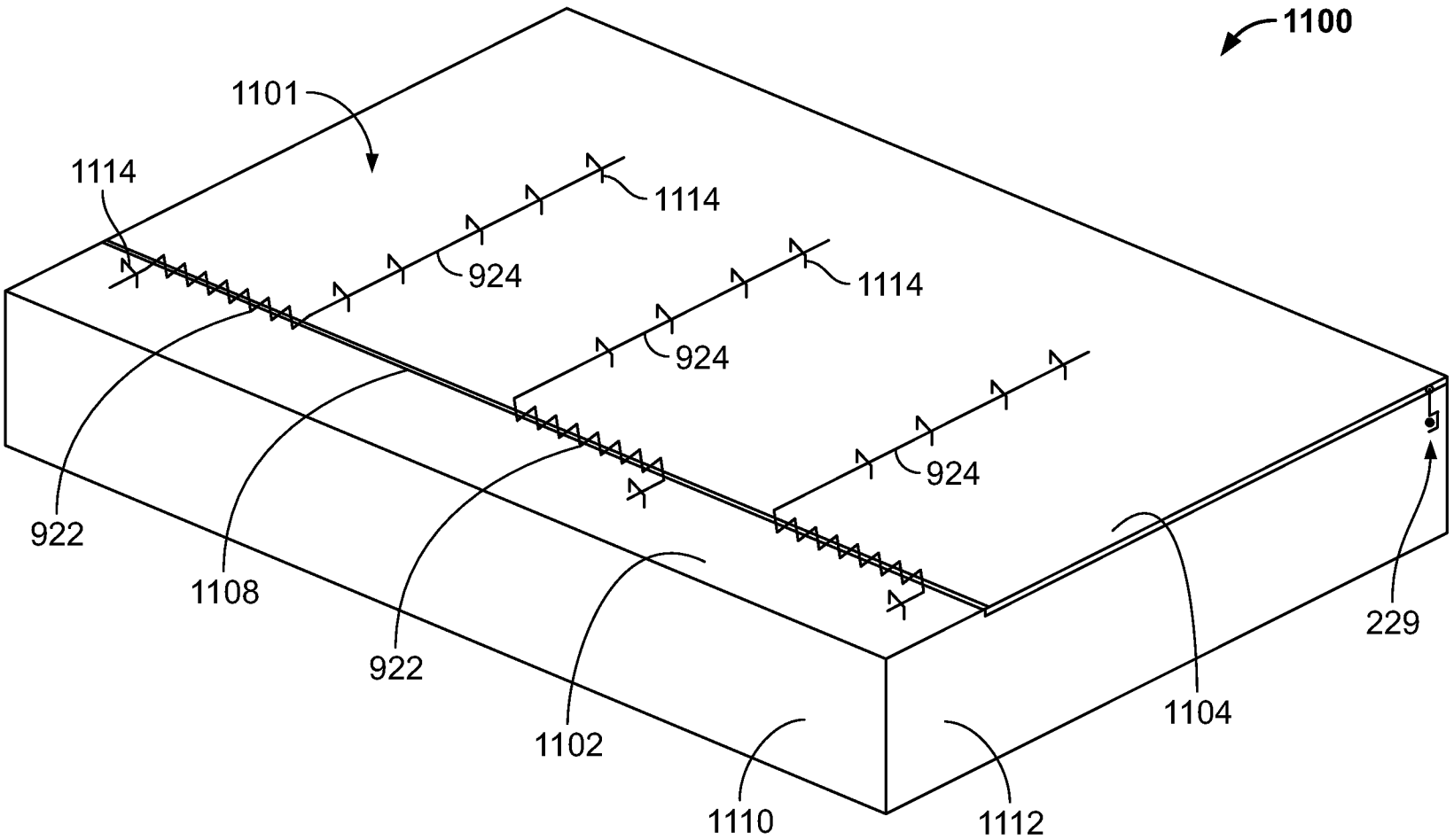
FIG. 11 illustrates another example cash tray assembly that can be used to implement the cash tray assembly of FIG. 1, where an example security flap includes an example living hinge and example eyelets that are structured to receive springs to bias a portion of the security flap toward an open position.

FIG. 11 illustrates an example cash tray assembly 1100 that is similar to the cash tray assembly 900 of FIG. 9. However, in contrast to the cash tray assembly 900 of FIG. 9, the cash tray assembly 1100 of FIG. 11 includes an example security flap 1101 having example first and second panels 1102, 1104 that are coupled using an example living hinge 1108. In this example, the first panel 1102 is integrally formed with a rear panel 1110 of an example cash tray 1112. Such an approach enables the cash tray assembly 1100 to be formed of a single piece using, for example, additive manufacturing processes. In other examples, the cash tray assembly 1100 may be formed of two or more pieces that are coupled. For example, the example security flap 1101 may be separately formed and later coupled to the cash tray 1112. As with the example illustrated in FIGS. 9, 10, the example cash tray assembly 1100 includes the extensions 924 that extend from adjacent the hinge 1108. To couple the extensions 924 to the first and second panels 1102, 1104, in this example, the panels 1102, 1104 define example eyelets and/or grooves 1114 that are structured to receive or house portions of the springs 922 and/or the extensions 924.

Figure 12:
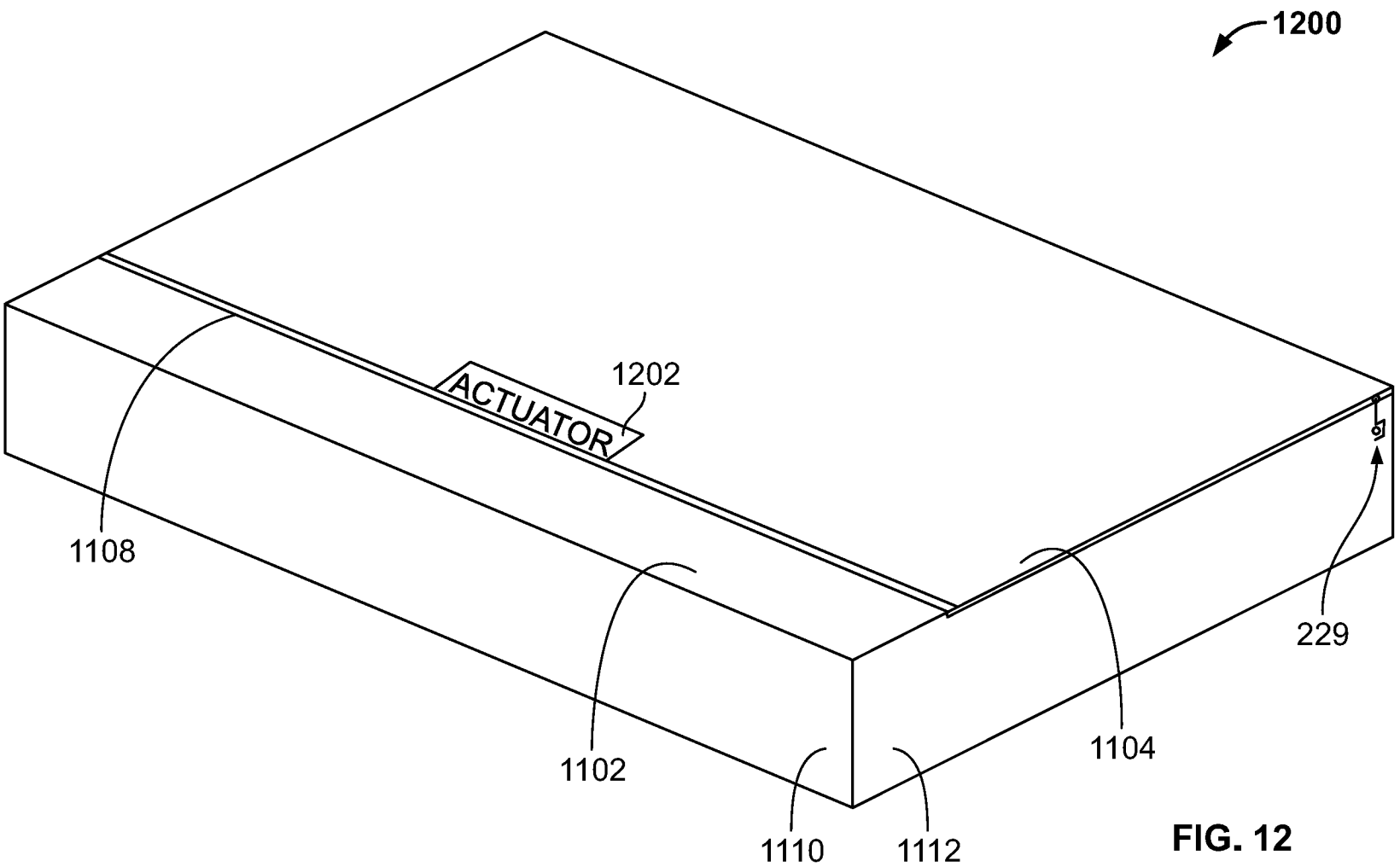
FIG. 12 illustrates another example cash tray assembly that can be used to implement the cash tray assembly of FIG. 1, where an example security flap includes an example actuator structured to actuate a portion of the security flap toward an open position when an event occurs.

FIG. 12 illustrates an example cash tray assembly 1200 that is similar to the cash tray assembly 1100 of FIG. 11. However, in contrast to the cash tray assembly 1100 of FIG. 11, the cash tray assembly 1200 of FIG. 12 includes an example actuator 1202 that is used to actuate the second panel 1104 between different positions. The actuator 1202 may be implemented as a Piezoelectric actuator, a linear actuator, a spring or any other type of actuator. In examples in which the actuator 1202 is implemented by a piezoelectric actuator and/or a linear actuator, a power source may be provided and the actuator 1202 may be structured to actuate the second panel 1104 to the open position when a first event occurs (e.g., a cash transaction take place) and to actuate the second panel 1104 to the closed position when a second event occurs (e.g., the second panel 1104 engages the interior surface 132 of the register housing 108).

Figure 13:
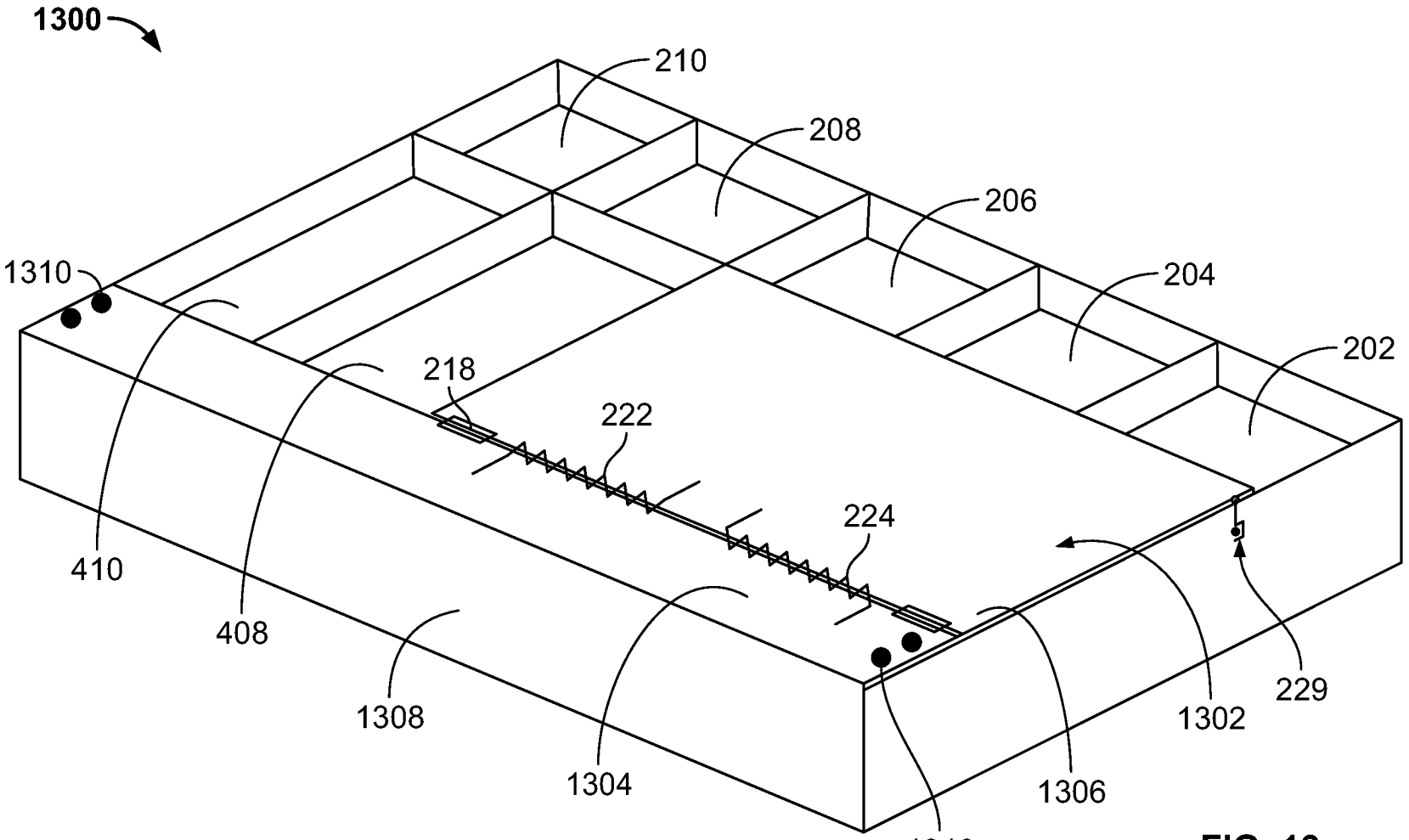
FIG. 13 illustrates another example cash tray assembly that can be used to implement the cash tray assembly of FIG. 1, where an example security flap is structured to cover some of the paper currency compartments of the cash tray.

FIG. 13 illustrates an example cash tray assembly 1300 that is similar to the example cash tray assembly 200 of FIG. 2. However, in contrast to the cash tray assembly 200 of FIG. 2, an example security flap 1302 includes an example first panel 1304 and an example second panel 1306, where the first panel 1304 is coupled to an example cash tray 1308 via fasteners 1310 and the example second panel 1306 is sized and/or structured to cover the paper currency compartments 402, 404, 406 when the second panel 3006 is in the closed position. In this example, the second panel 1306 is sized and/or structured to enable access to the paper currency compartments 408, 410 and the coin compartments 202, 204, 206, 208, 210 when the second panel 1306 is positioned in either the open position or the closed position.

Figure 14:
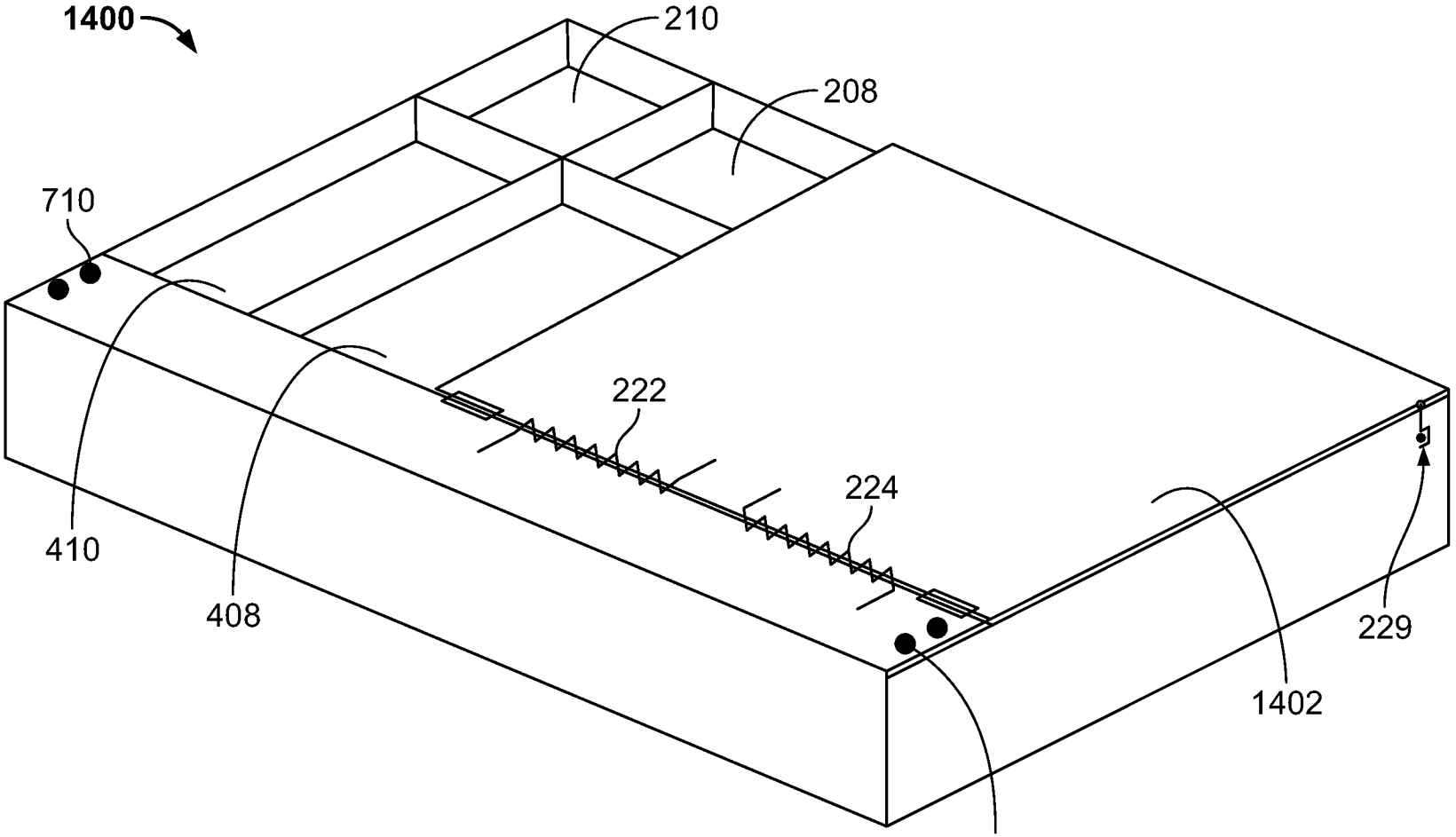
FIG. 14 illustrates another example cash tray assembly that can be used to implement the cash tray assembly of FIG. 1, where an example security flap is structured to cover some of the paper currency compartments and some of the coin compartments of the cash tray.

FIG. 14 illustrates an example cash tray assembly 1400 that is similar to the cash tray assembly 1300 of FIG. 13. However, in contrast to the cash tray assembly 1300 of FIG. 13, the cash tray assembly 1400 includes an example second panel 1402 that is sized and/or structured to cover the paper currency compartments 402, 404, 406 and the coin compartments 202, 204, 206 when the second panel 1402 is in the closed position. In this example, the second panel 1402 is sized and/or structured to enable access to the paper currency compartments 408, 410 and the coin compartments 208, 210 when the second panel 1402 is positioned in either the open position or the closed position.

An example apparatus includes a security flap including a panel, the panel structured to extend over compartments of a cash tray to prevent visual access to contents of the compartments when the cash tray extends a first distance from a register housing, the panel structured to enable visual access to the contents of the compartments when the cash tray extends a second distance from the register housing, the first distance associated with a non-cash transaction taking place and the second distance being associated with a cash transaction taking place.

An example apparatus, includes a security flap including means for covering compartments of a cash tray when a non-cash transaction takes place and uncovering the compartments of the cash tray when a cash transaction takes place. In some examples, the security flap includes a first panel and a second panel, the means for covering the compartments of the cash tray when the non-cash transaction takes place and uncovering the compartments of the cash tray when the cash transaction takes place includes the second panel.

Further, while several examples have been disclosed herein, any features from any examples may be combined with or replaced by other features from other examples. Moreover, while several examples have been disclosed herein, changes may be made to the disclosed examples within departing from the scope of the claims.

What is claimed:

1. An apparatus, comprising:

a cash tray having a base and a plurality of walls that extend from the base and define a plurality of paper-currency compartments, a plurality of distal edges of the walls define openings of the paper-currency compartments;

a plurality of bill weights, each bill weight movable within one of the paper-currency compartments; and a spring-biased security flap coupled to the cash tray and adapted to engage or be immediately adjacent the distal edges of the walls of at least two of the paper-currency compartments to cover the corresponding openings and the corresponding distal edges.

2. The apparatus of claim 1, wherein the spring-biased security flap comprises a spring hinge.

3. The apparatus of claim 1, wherein the spring-biased security flap comprises a pair of spring hinges.

4. The apparatus of claim 1, wherein the security flap comprises a first panel and a second panel, the first panel being fixed to the cash tray and the second panel being movably coupled to the second panel.

5. The apparatus of claim 4, wherein the walls of the cash tray comprise exterior walls and wherein the first panel and the second panel fully extend between at least two of the exterior walls.

6. The apparatus of claim 1, wherein the security flap is adapted not to extend into a dimensional envelope of the at least two of the paper-currency compartments.

7. The apparatus of claim 1, wherein the walls of the cash tray comprise exterior walls and wherein the security flap is adapted to engage or be immediately adjacent the distal edges of at least two of the exterior walls.

8. The apparatus of claim 1, wherein the walls of the cash tray comprise exterior walls and wherein the security flap is adapted to engage or be immediately adjacent the distal edges of at least one of the exterior walls.

9. The apparatus of claim 1, wherein the security flap is coupled to the cash tray via a living hinge.

10. The apparatus of claim 1, wherein the walls further define coin compartments and wherein the security flap is adapted to cover one or more of the coin compartments.

11. The apparatus of claim 1, further comprising a lock to secure the security flap relative to the cash tray.

12. The apparatus of claim 11, wherein the lock comprises a protrusion and a latch that interacts with the protrusion.

13. The apparatus of claim 12, wherein the latch is carried by the security flap.

14. The apparatus of claim 1, wherein the security flap is adapted to fully cover the corresponding opening.

15. An apparatus, comprising:

a cash tray having a plurality of walls, the walls define compartments having corresponding openings, the cash tray comprises a spring-biased security flap adapted to engage or be immediately adjacent distal edges of the walls of at least two of the compartments and to cover the corresponding openings and the corresponding distal edges, the cash tray further comprises a plurality of bill weights, each bill weight movable within one of the compartments.

16. The apparatus of claim 15, further comprising a register drawer adapted to carry the cash tray and a register housing adapted to receive the register drawer and the cash tray.

17. The apparatus of claim 15, wherein the security flap is coupled to the cash tray via a hinge.

18. The apparatus of claim 15, wherein the security flap is adapted to fully cover the corresponding openings.

19. The apparatus of claim 15, wherein the security flap is directly coupled to or adjacent to a rear wall of the cash tray via a hinge.

20. A method of operating a cash register, comprising:

moving a cash tray a first distance from a register housing, the cash tray having a base and a plurality of walls that extend from the base and define a plurality of paper-currency compartments, the cash tray further comprises a plurality of bill weights, each bill weight movable within one of the paper-currency compartments, wherein a plurality of distal edges of the walls define openings of the paper-currency compartments;

enabling a spring-biased security flap to interact with an interior surface of the register housing to enable the security flap to engage or be immediately adjacent the distal edges of at least two of the paper-currency compartments and to cover the corresponding openings and the corresponding distal edges;

moving the cash tray a second distance from the register housing; and enabling the security flap to move from covering the corresponding openings to provide visual access thereto.

21. The method of claim 20, further comprising removing the cash tray from a register drawer of the register housing and securing the security flap relative to the cash tray via a lock.

* * * * *